US009277775B2

(12) United States Patent
Lopez

(10) Patent No.: US 9,277,775 B2
(45) Date of Patent: Mar. 8, 2016

(54) BELT WITH INTERCHANGEABLE ACCESSORIES

(71) Applicant: Carlos A. Lopez, Miami, FL (US)

(72) Inventor: Carlos A. Lopez, Miami, FL (US)

( * ) Notice: Subject to any disclaimer, the term of this patent is extended or adjusted under 35 U.S.C. 154(b) by 245 days.

(21) Appl. No.: 14/141,542

(22) Filed: Dec. 27, 2013

(65) Prior Publication Data

US 2015/0181964 A1 Jul. 2, 2015

(51) Int. Cl.
*A41F 9/00* (2006.01)
*A41D 27/08* (2006.01)
*A41D 15/00* (2006.01)

(52) U.S. Cl.
CPC . *A41F 9/00* (2013.01); *A41D 15/00* (2013.01); *A41D 27/085* (2013.01); *A41F 9/002* (2013.01)

(58) Field of Classification Search
CPC ..... A41F 9/00; A41F 9/002; Y10T 24/3413; Y10T 24/4016; Y10T 24/4072; A44B 1/00; A44B 1/04; A44B 1/018; A44B 1/185; A45D 2008/006
USPC ..... 224/660, 663, 665, 671, 672, 674, 675, 224/255, 268, 269; 63/11
See application file for complete search history.

(56) References Cited

U.S. PATENT DOCUMENTS 2,430,957 A * 11/1947 Seitz ..... A41F 9/002 2/321
2,542,479 A * 2/1951 Costner ..... A41F 9/002 2/321
2,596,884 A 5/1952 Bailen
3,063,058 A * 11/1962 Vollet ..... A41F 9/002 2/338
3,848,270 A 11/1974 Rand
4,214,686 A 7/1980 Dostourian
4,377,872 A * 3/1983 Daniell, Jr. ..... A41F 9/002 2/321
4,715,839 A 12/1987 Ford et al.
5,054,433 A * 10/1991 Pfleger ..... A01K 27/005 119/654
5,664,439 A * 9/1997 Dickerson ..... A44B 6/00 132/278
5,732,448 A * 3/1998 Shields ..... A44B 11/22 24/170
5,806,145 A * 9/1998 Chen ..... A44B 11/14 24/170
7,159,281 B1 1/2007 Irizarry
D557,878 S 12/2007 Haefner et al.
8,087,560 B2 1/2012 Crye
2004/0163297 A1 8/2004 Lin
2006/0162051 A1 7/2006 Bachechi (Continued)

OTHER PUBLICATIONS

Website, http://www.belk.com/AST/Main/Belk_Primary/Men/Featured_shop/golf/accessories/PRD~ . . . , Pro Tour Silicone Perforated Belt, two sheets printed from the internet on Feb. 28, 2013.

*Primary Examiner* — Adam Waggenspack

(57) ABSTRACT

The belt with interchangeable accessories is formed of a soft, resilient elastomer and includes a series of notches along its upper and lower edges. An accessory or accessories is/are adapted for removable and interchangeable installation on the belt. Each accessory has a pair of elastic loops extending from the back thereof. Each loop passes through corresponding notches of the belt to secure the accessory removably to the belt. The accessories may comprise a large number of different configurations, e.g., two-dimensional and three-dimensional representations, storage compartments for makeup or other purposes, mirrors or other reflective surfaces, electrically lighted displays, etc. A removable buckle is provided. The rearward portion of the buckle has a passage therethrough, the passage gripping one end of the belt therein. The overlying portion of the buckle has a channel and openable cover for removably securing the opposite end of the belt in the resulting passage.

20 Claims, 9 Drawing Sheets

(56) References Cited

U.S. PATENT DOCUMENTS

2010/0186195 A1 7/2010 Huang et al.
2012/0144562 A1 6/2012 Ferrara et al.
2012/0284965 A1 11/2012 Plekker et al.

* cited by examiner

BELT WITH INTERCHANGEABLE ACCESSORIES

BACKGROUND OF THE INVENTION

1. Field of the Invention

The present invention relates generally to apparel, and particularly to a belt having one or more decorative accessories that may be installed, removed, and/or interchanged upon the belt.

2. Description of the Related Art

Ornamental embellishments and attachments for apparel have been known since prehistoric times. There appears to be a natural desire on the part of virtually all people to enhance their appearance in some manner to provide a distinctive and eye catching appearance. The manufacture and sale of various ornaments for temporary attachment to conventional articles of clothing is evidence of this trait.

Perhaps the other side of this trait is the nearly universal desire to clothe and cover the body in some manner. As clothing and apparel have evolved, separate garments for the upper and lower portions of the body were developed. Generally, the wear of pants, slacks, shorts, etc. requires a belt or the like around the waist to support the pants on the hips of the wearer. Belts may be used as well for the temporary or permanent attachment of various articles, e.g., tools, cell phone pouches, military hardware and equipment, etc.

Belts as such are utilitarian articles, with little or no ornamental embellishment. However, it is known to decorate some belts (particularly leather belts) with permanent ornamentation, and/or to provide a decorative buckle for the belt. Although such decorative buckles are generally removable and interchangeable, the decor (if any) of the belt per se cannot be changed or modified in such situations.

Thus, a belt with interchangeable accessories solving the aforementioned problems is desired.

SUMMARY OF THE INVENTION

The belt with interchangeable accessories includes a belt formed of a resilient elastomer material such as silicone plastic or rubber, and at least one accessory that may be removably attached thereto. The belt includes a series of notches along its upper and lower edges, and the accessory includes upper and lower elastic loops that pass through corresponding upper and lower notches to secure the accessory to the belt. The outer surface of the belt, i.e., the surface normally exposed when the belt is worn, includes a receptacle for seating a corresponding button or protrusion on the back of the accessory. The elastic loops extend from this button or protrusion. The inner surface of the belt, i.e., the belt surface immediately adjacent to the underlying clothing when the belt is worn, includes a series of upper and lower lateral grooves or channels, with the elastic loops of the accessory residing in the channels when installed upon the belt.

There are no specific limitations regarding the configuration of the accessory, other than that its size must be compatible with the dimensions of each attachment position on the belt. The accessories may comprise relatively simple two-dimensional pictures (photos, artwork, etc.) and may be covered by a transparent protective coating (epoxy, etc.). Alternatively, the accessories may be formed in bas-relief of a series of laminations of plastic material (e.g., polyvinyl chloride, etc.) to provide a three-dimensional effect. Other accessories may include storage compartments for makeup or for the containment of other articles or material. A mirror or other reflective surface may be provided with such an accessory.

Another alternative would be to equip the accessory with an electrically illuminated display, e.g., LEDs or other principle of illumination, and a small electrical storage cell or battery for power. Additional alternatives may be provided as well.

A removable buckle is provided for the belt. The buckle includes a rear passage into which or through which a first end of the belt is passed. A hinged clasp pivots down over the portion of the belt in the passage, with the clasp having a series of inwardly oriented teeth to grip the belt and prevent relative movement between the belt and the buckle. The opposite front, or outward facing, portion of the buckle has a selectively open channel with a hinged cover defining a passage when the cover is closed over the channel. The opposite second end of the belt is placed in the channel, and the cover is secured to capture the belt in the resulting passage. The inner surface of the cover includes a pair of spaced apart pins that engage corresponding notches along the edges of the belt, to prevent movement of the second end of the belt relative to the buckle.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
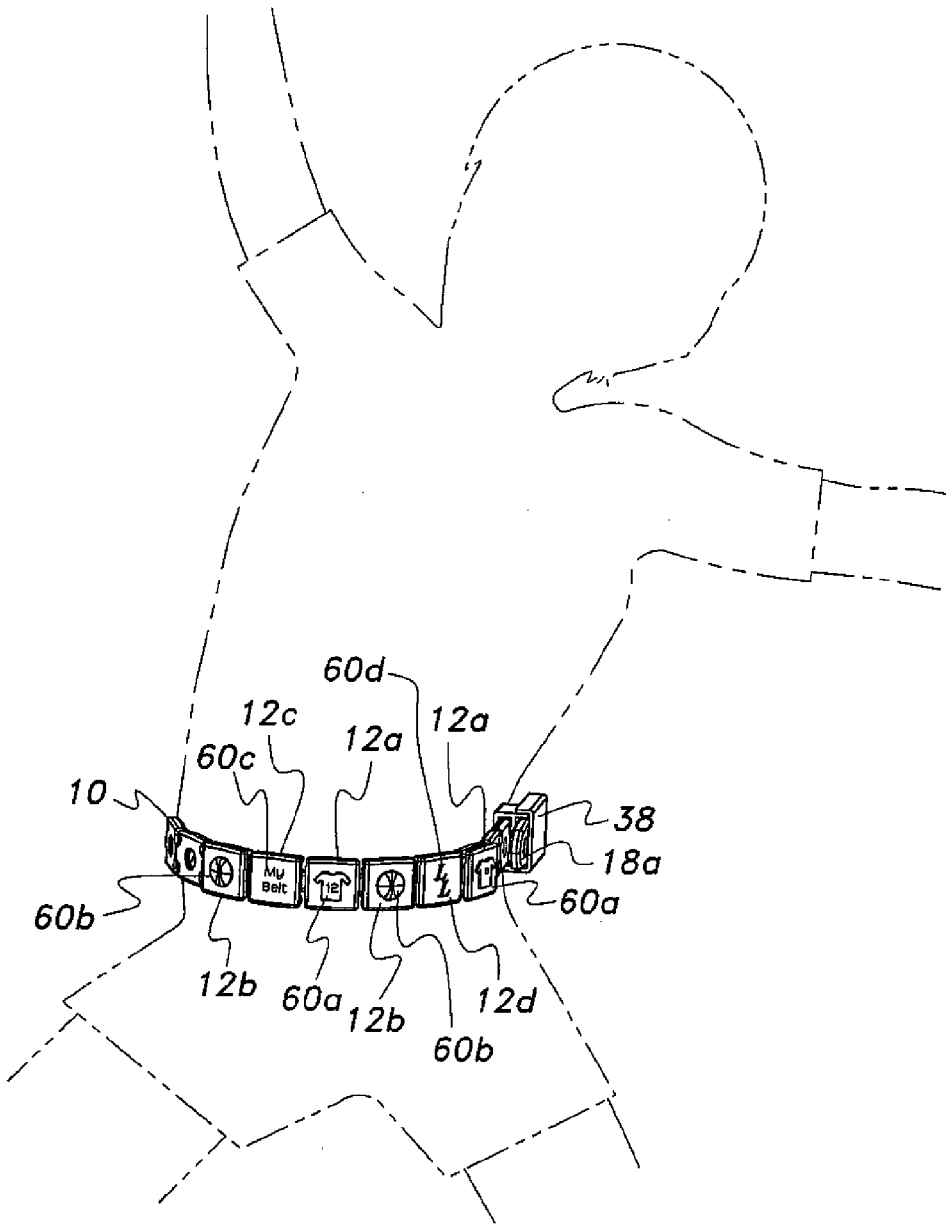
FIG. 1 is an environmental, perspective view of a belt with interchangeable accessories according to the present invention, illustrating its general configuration.

The belt with interchangeable accessories includes a belt adapted for the removable installation of one or more decorative accessories thereto. FIG. 1 of the drawings provides an environmental perspective view of an exemplary belt 10 having a plurality of removably installed and interchangeable accessories 12*a* through 12*d* installed thereon, with FIG. 2 providing a more detailed perspective view of the belt 10 with various accessories 12*a* and 12*e* attached thereto and other accessories 12*f* and 12*g* separated therefrom.

Figure 2:
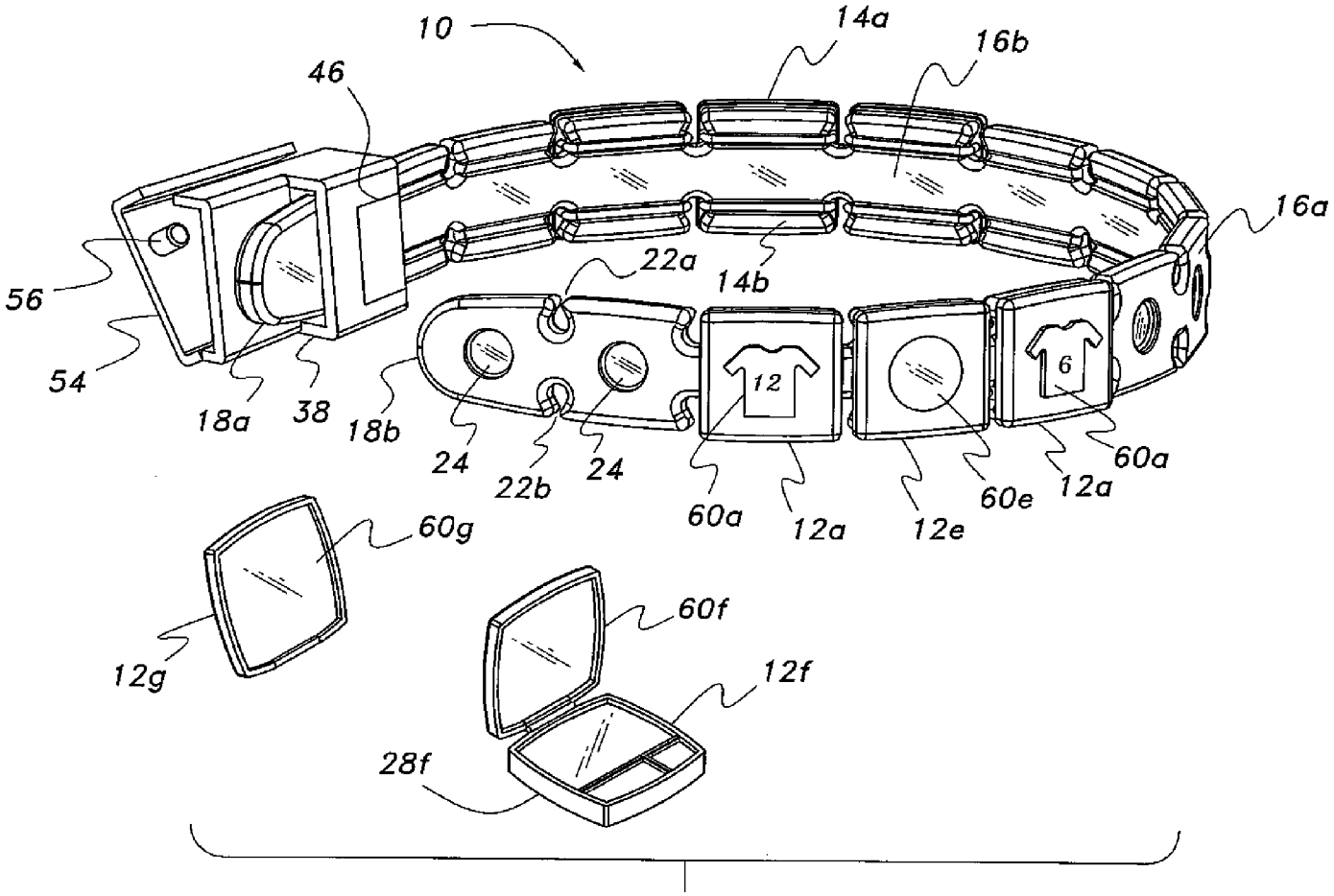
FIG. 2 is an exploded perspective view of the belt with interchangeable accessories according to the present invention, illustrating the belt and a plurality of interchangeable accessories therewith.

The belt 10 shown in detail in FIG. 2 comprises a flexible, elongate strap having an upper edge 14*a* and opposite lower edge 14*b*, an outer surface 16*a* and opposite inner surface 16*b*, and a first end 18*a* and opposite second end 18*b*. The belt or strap 10 is formed as a unitary component in a continuous unbroken length and is preferably formed of an elastomer such as silicone plastic or the like, although other materials may be used as desired.

The belt or strap 10 includes a plurality of segments 20, with exemplary segments being shown in greater detail in FIGS. 3 through 5E. The segments 20 are defined by a corresponding series of notches 22*a* and 22*b* formed respectively in the upper and lower edges 14*a* and 14*b* of the belt or strap 10, with the notches 22*a* and 22*b* providing for the removable attachment of the accessories thereto as described in detail further below. Each of the segments 20 includes a receptacle 24 formed in the outer surface 16*a* of the belt or strap 10, i.e., the surface disposed away from the wearer of the belt 10 when the belt is being worn. The opposite inner surface 16*b*, i.e., the surface adjacent the clothing of the wearer when the belt is being worn, includes laterally disposed upper and lower channels, respectively 26*a* and 26*b*, across each of the segments 20 and extending between corresponding pairs of the respective notches 20*a* and 20*b*.

Figure 3:
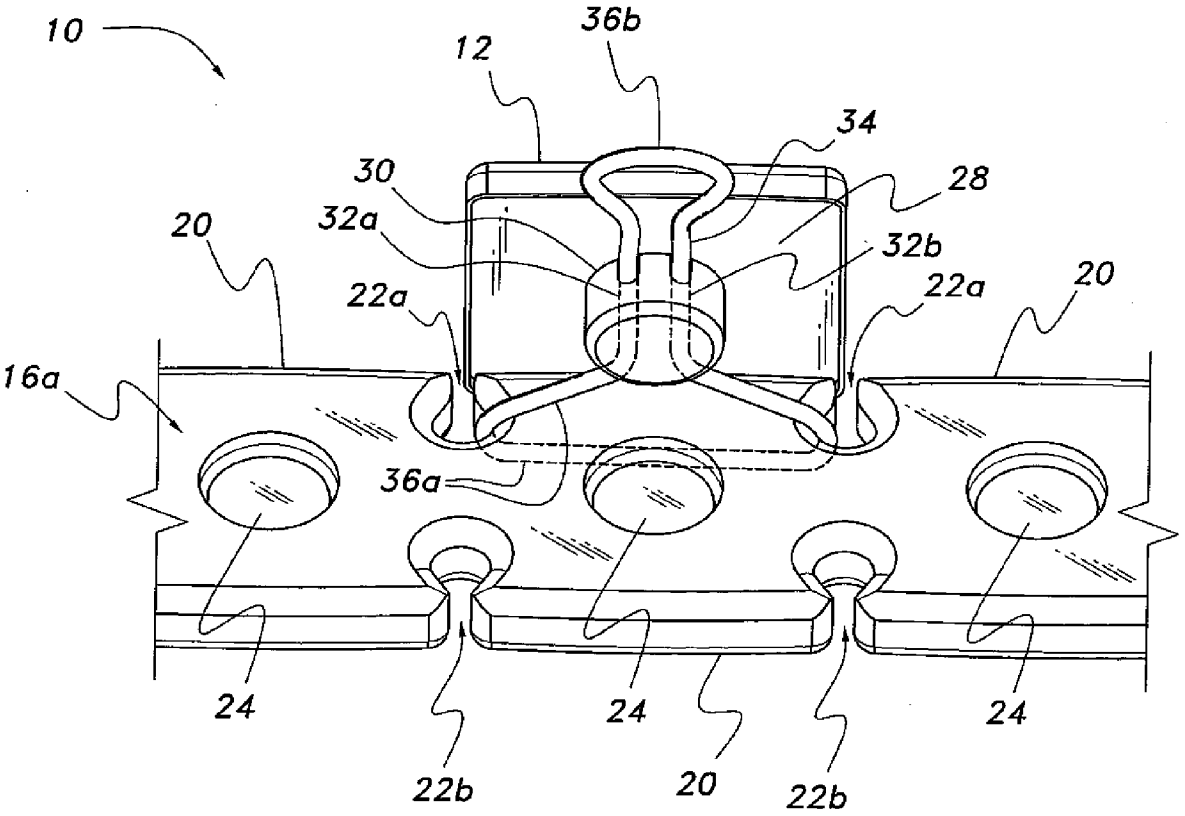
FIG. 3 is a detailed perspective view of the outer surface of a portion of the belt with interchangeable accessories according to the present invention, illustrating an interchangeable accessory partially attached thereto.
Figure 4:
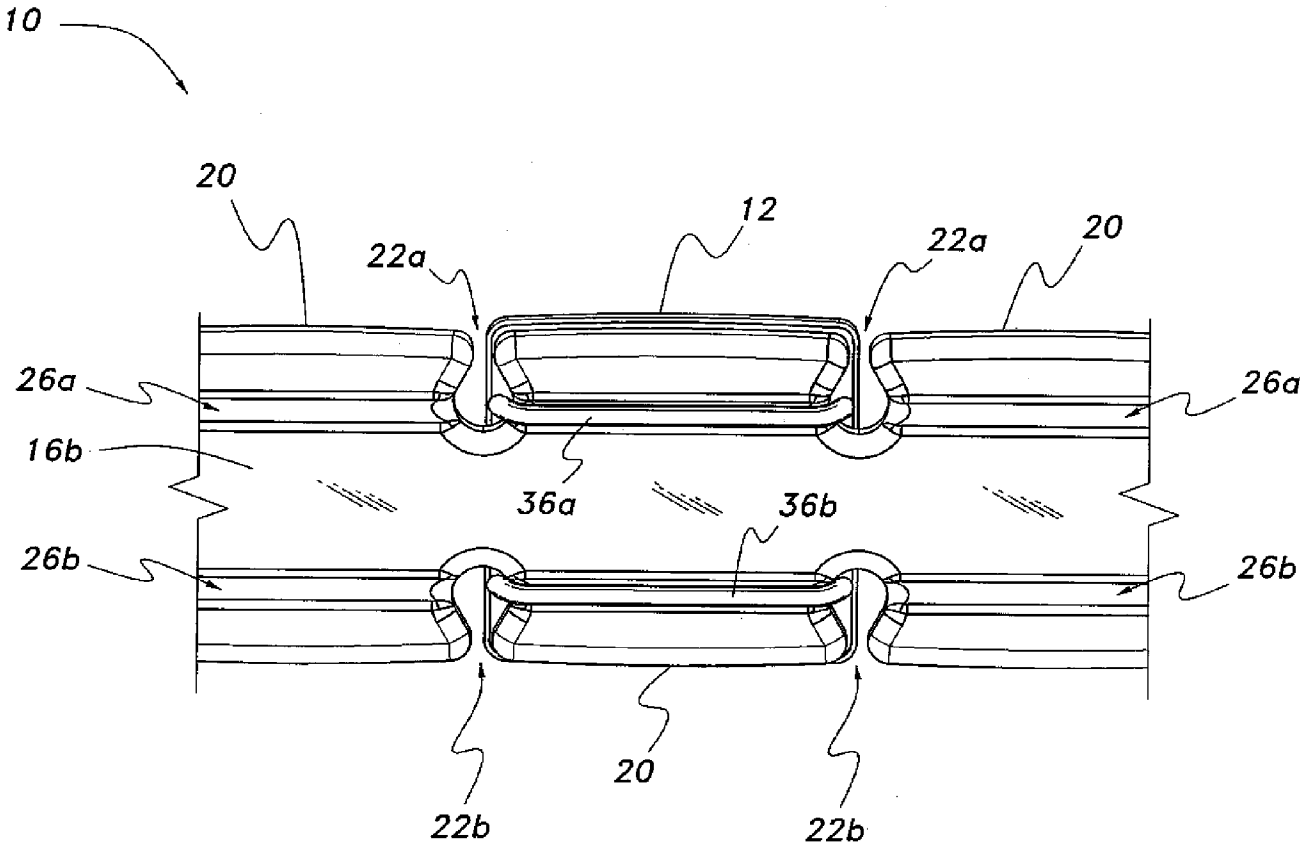
FIG. 4 is a detailed perspective view of the inner surface of a portion of the belt with interchangeable accessories according to the present invention, illustrating an interchangeable accessory completely attached thereto.

The removable and interchangeable attachment of the accessories to the belt or strap 10 is illustrated in FIGS. 3 and 4, with FIG. 3 showing the front or outer side 16*a* of the belt or strap 10 and FIG. 4 illustrating the completed installation of an accessory from the rear or inner side 16*b* of the belt or strap 10. The attachment face of a generic accessory 12 is illustrated in FIG. 3, with it being understood that the accessory 12 of FIG. 3 may represent any of the specific accessories 12*a* through 12*g* shown in FIGS. 1 and 2 or other accessory configurations as desired. Each of the accessories, e.g., the accessory 12 of FIGS. 3 and 4, has a back surface or attachment face 28 with a button 30 protruding therefrom. The button 30 is configured to seat within a corresponding receptacle 24 in the front or outer surface 16*a* of the belt or strap 10 when the accessory 12 is installed upon the belt.

The button 30 includes a pair of spaced apart passages, respectively 32*a* and 32*b*, therethrough, shown in broken lines in FIG. 3. The passages 32*a* and 32*b* are oriented substantially vertically when the accessory 12 is installed upon the belt or strap 10 and the belt is being worn about the waist of a standing person. An endless elastic cord or band 34 is installed through the button passages 32*a* and 32*b*, with the cord or band 34 having upper and lower elastic loops, respectively 36*a* and 36*b*, extending from the button 30. (It will be seen that the accessory 12 is inverted as shown in FIG. 3, with the upper elastic loop 36*a* being shown below the lower elastic loop 36*b*.) The accessory 12 is removably installed upon the belt or strap 10 by stretching the upper elastic loop 36*a* to seat in the corresponding upper notches 22*a* of one of the belt segments 20, and seating the button 30 of the accessory 12 in the receptacle 23 of the belt segment. The lower elastic loop 36*b* is then stretched to seat in the corresponding lower notches 22*b* of the belt or strap 10 to complete the accessory installation. Removal of the accessory 12 is essentially the reverse of the above-described installation procedure.

FIG. 4 provides a rear view of the belt or strap 10 showing the completed installation of the accessory 12 thereto. The back or inner surface 16*b* of the belt or strap 10 includes parallel, spaced apart upper and lower channels 26*a* and 26*b* extending between corresponding upper and lower notches 22*a* and 22*b*, as noted further above. These channels 26*a* and 26*b* serve to contain the respective upper and lower loops 36*a* and 36*b* of the elastic cord 34 (FIG. 3) so that they do not protrude above the inner surface 16*b* of the belt or strap 10. This greatly reduces wear and tear on the loops 36*a* and 36*b*, and provides greater comfort for the person wearing the belt 10 when such accessories 12 are installed thereon.

FIGS. 5A through 5E provide details of a fastening member 38, such as a buckle 38, developed for use with the belt or strap 10. The buckle 38 essentially includes two joined portions, with each portion adapted to grip a portion of the belt or strap 10 therein. The rear portion 40 of the buckle 38 includes a first strap passage 42 disposed laterally therethrough, with the passage 42 being defined by a rear wall 44. A clasp 46 is hinged across the rear wall 44, with the clasp 46 forming a portion of the rear wall 44 and defining a portion of the first strap passage 42 when closed. The clasp 46 includes a plurality of belt gripping teeth 48 that extend inwardly to grip the belt 10 when the belt is inserted into the first strap passage 42 and the clasp is closed over the belt.

Figure 5A:
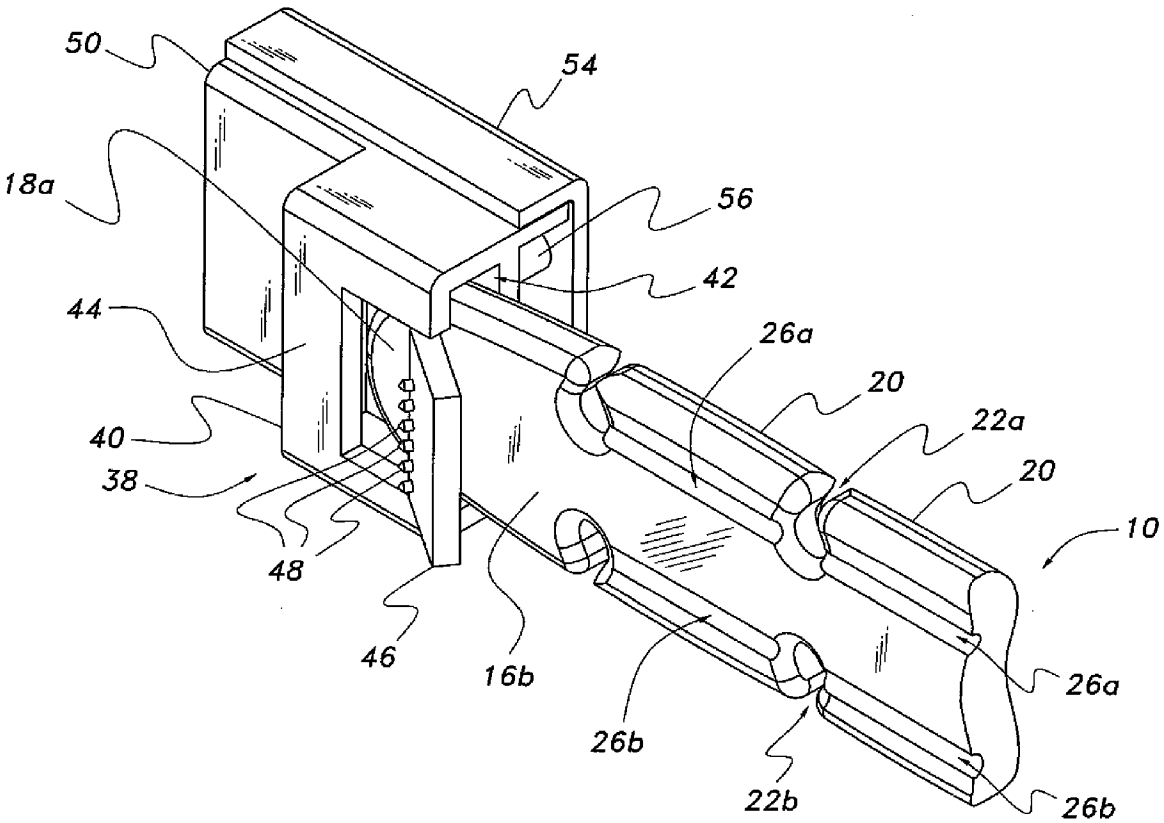
FIG. 5A is an exploded perspective view of the inner surface of a first end of the belt with interchangeable accessories according to the present invention and the buckle associated therewith, showing the means for attaching the buckle to the first end of the belt.
Figure 5B:
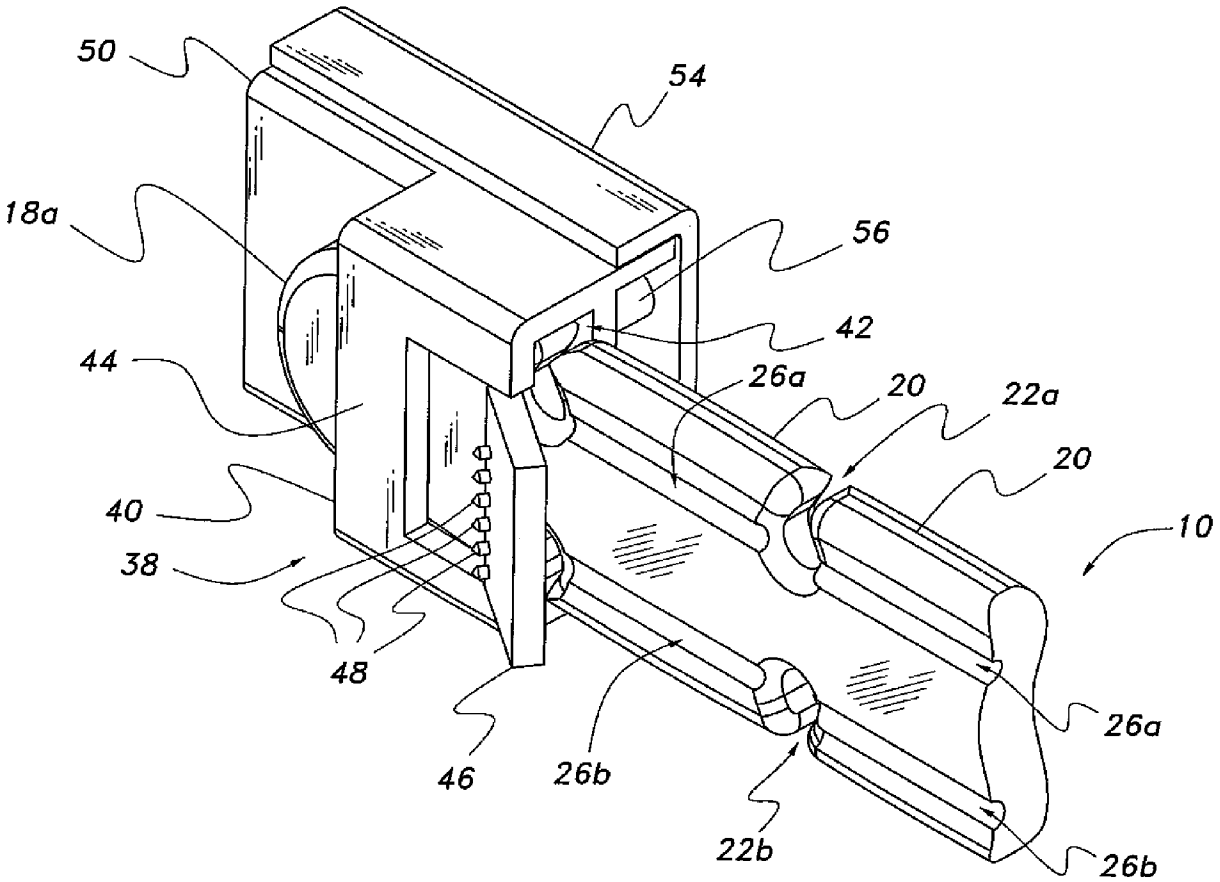
FIG. 5B is a perspective view of the inner surface of the belt with interchangeable accessories according to the present invention, showing the first end of the belt inserted into the buckle.
Figure 5C:
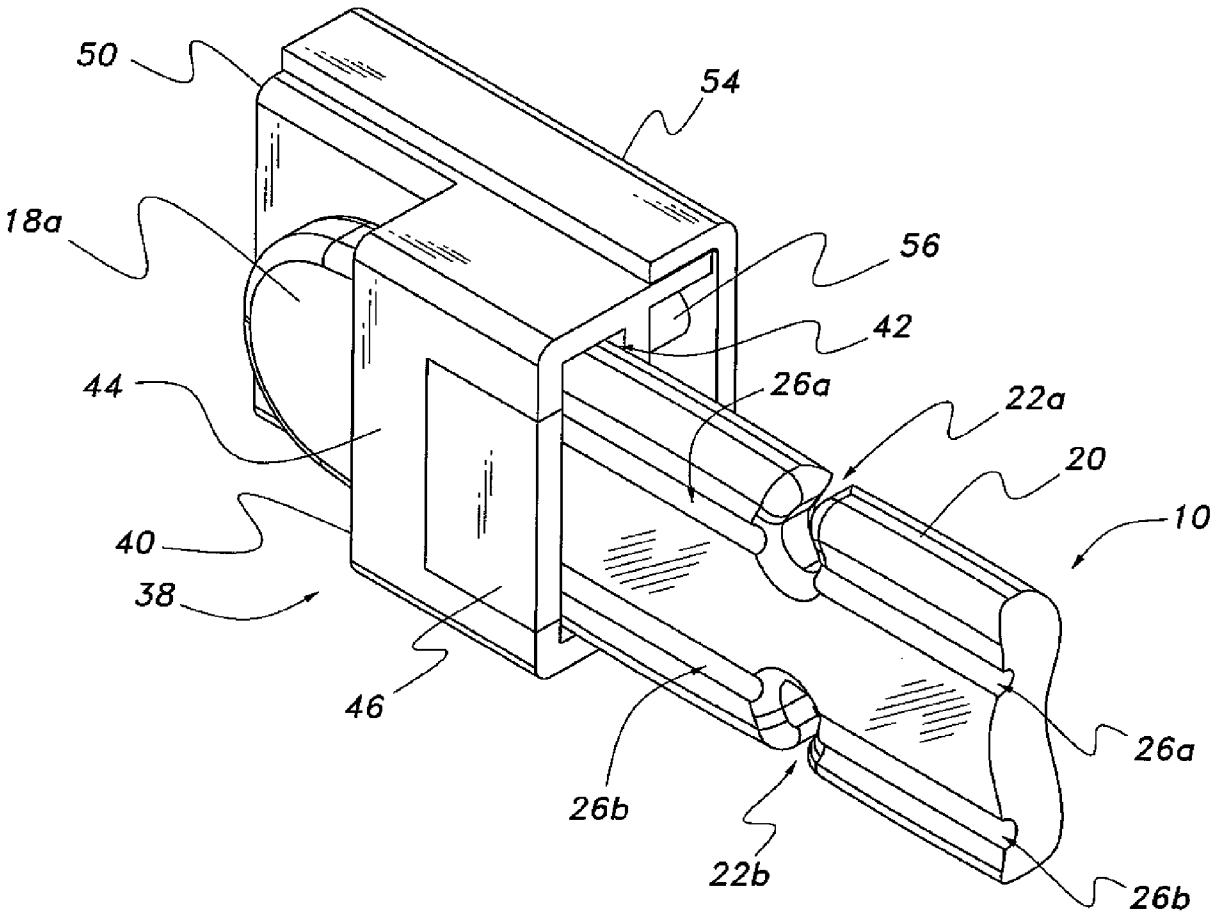
FIG. 5C is a perspective view of the inner surface of the belt with interchangeable accessories according to the present invention, showing the completed installation of the buckle upon the first end of the belt.

FIGS. 5A through 5C illustrate the placement of the first end 18*a* of the belt or strap 10 into the first strap passage 42 of the buckle 38, and the securing of the belt or strap 10 therein. Initially, the clasp 46 is opened and the first end 18*a* of the belt or strap 10 is inserted into the first or rear strap passage 42. When the first end 18*a* of the belt or strap 10 has been passed through the first or rear strap passage 42 for a suitable distance, the clasp 46 is closed, with the teeth 48 of the clasp 46 engaging the material of the belt or strap 10. A force on the belt or strap 10 in a direction opposite to the insertion direction has the effect of urging the clasp 46 more tightly closed, due to the orientation of the clasp teeth 48 and the hinge line of the clasp 46.

Figure 5D:
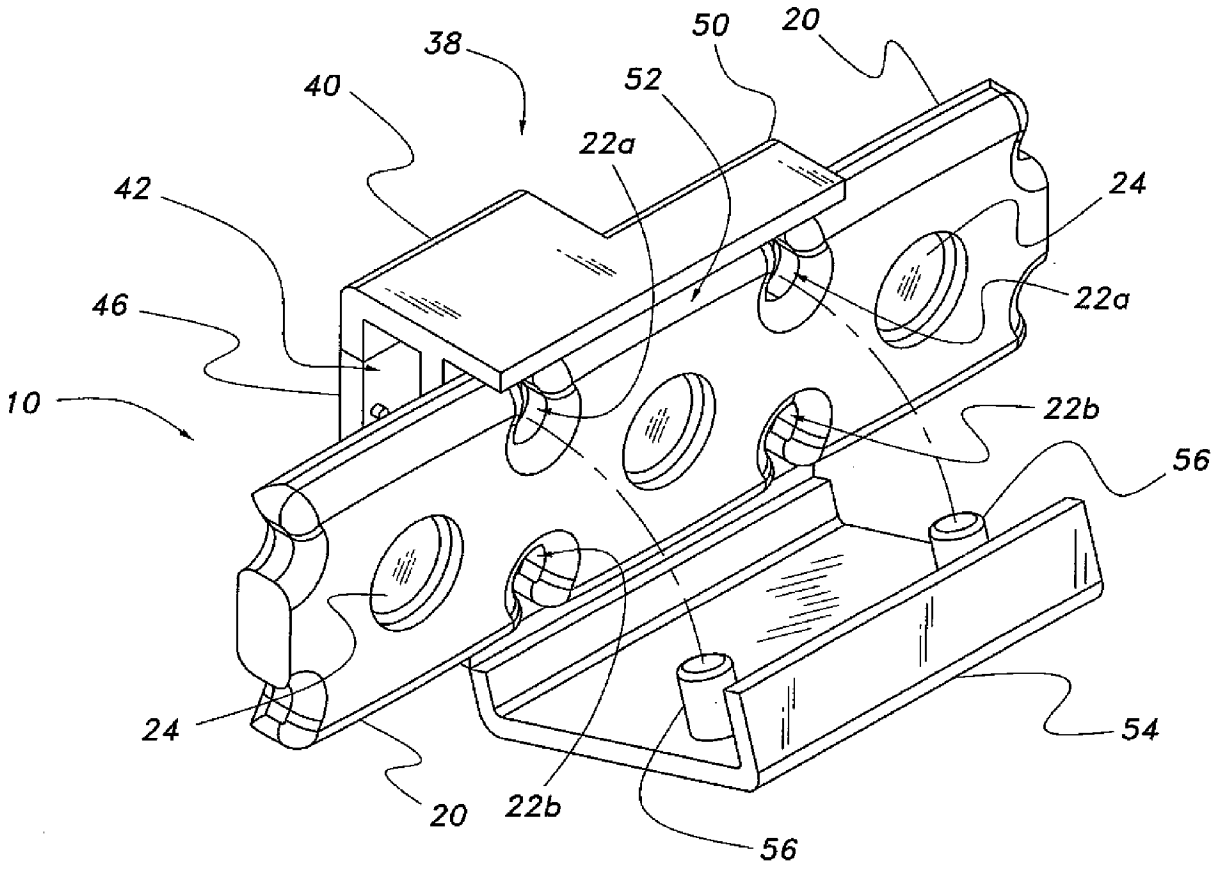
FIG. 5D is a perspective view of the outer surface of the belt with interchangeable accessories according to the present invention, showing the means for removably and adjustably securing the second end of the belt in the buckle.
Figure 5E:
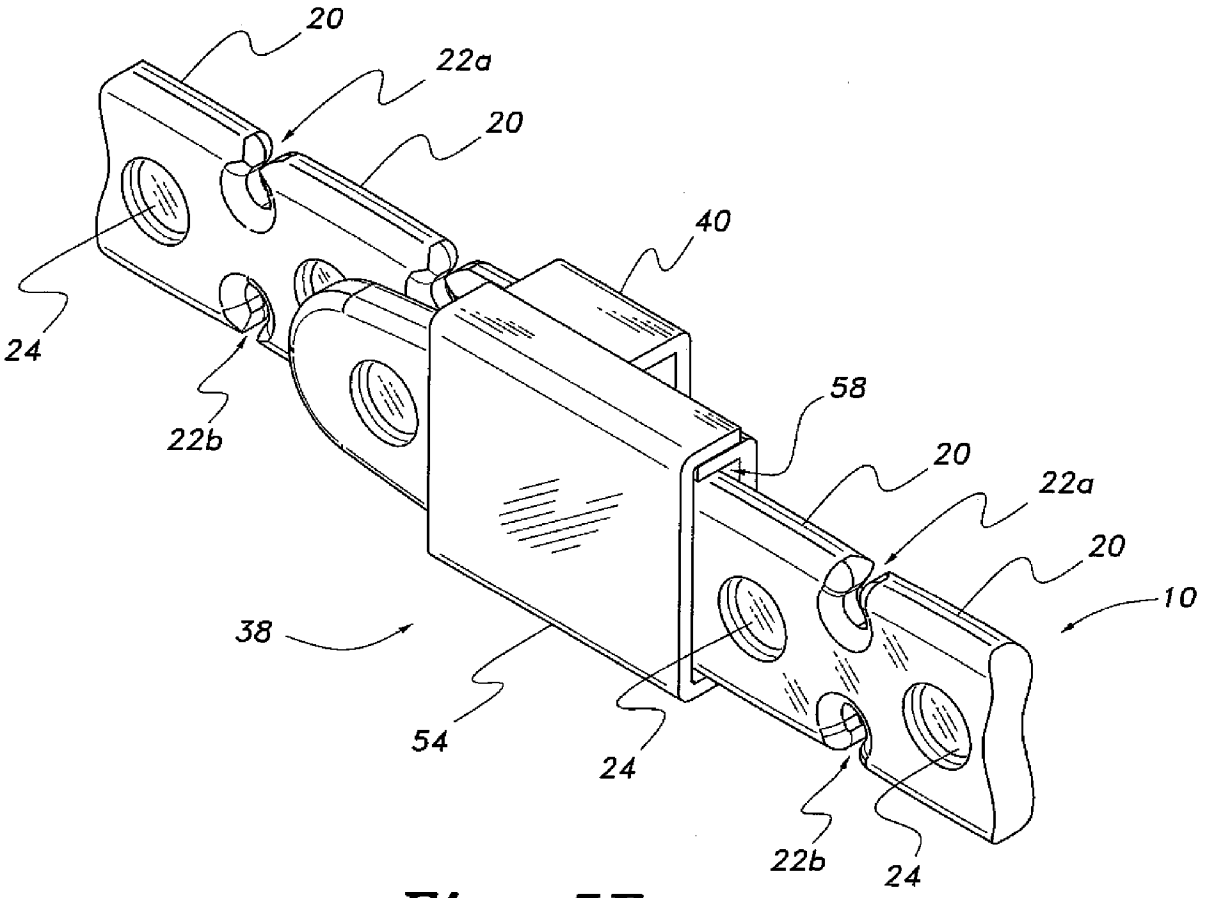
FIG. 5E is a perspective view of the belt with interchangeable accessories according to the present invention, illustrating the completed installation and closure of the buckle upon the belt.

FIGS. 5D and 5E illustrate the adjustable placement of the opposite portion of the belt or strap 10 in the buckle 38. The buckle 38 includes a front portion 50 overlying the rear portion 40, for the adjustable placement of the second end 18*b* therein (or placement of a portion of the belt adjacent to the second end). The front portion 50 of the buckle 38 has a lateral channel 52 disposed therethrough, with a hinged cover 54 attached along one edge of the channel 52. The cover 54 includes at least one, and preferably a plurality of, inwardly disposed pins 56 adapted to engage corresponding notches 22*a* and/or 22*b* of the belt or strap 10 when the belt or strap has been placed in the channel 52 and the cover 54 closed thereover. The cover 54 and channel 52 define a second strap passage 58 when the cover is selectively closed over the channel.

FIG. 5D illustrates the initial placement of the second end 18*b*, or adjacent portion, of the belt or strap 10 in the front portion 50 of the buckle 38. A selected portion of the belt or strap 10 is placed in the channel 52 of the front portion of the buckle, and positioned such that the pins 56 of the cover 54 will pass through corresponding upper notches 22*a* of the belt or strap 10 when the cover 54 is closed. Additional pins, not shown, may be provided to engage the lower notches 22*b* in addition to or in lieu of the pins 56 illustrated. The cover 54 is then pivoted upward from its hinge line to position the pins 56 through the selected notches 22*a* of the belt or strap 10. The cover 54 is closed to define the second or front strap passage 58, as shown in FIG. 5E of the drawings.

The various interchangeable accessories generally described further above may comprise practically any configuration. All of the accessories have certain common features, such as the rear surface 28 with its protruding button 30 and elastic cord 34. Each of the accessories further has a front decorative face that is exposed for viewing when the belt or strap is properly worn with the accessories properly attached as illustrated in FIG. 1. For example, the interchangeable accessory 12*a* illustrated in FIGS. 1 and 2 has a front decorative face 60*a* formed by laminating two or more sheets of plastic material to one another to create a three dimensional built-up configuration. In the exemplary accessory 12*a*, it will be seen that an upper layer or sheet having a configuration representing a sports jersey or T-shirt has been applied to the underlying surface. The exemplary accessory 12*b* of FIG. 1 is similarly constructed, with the front face 60*b* having a three-dimensional bas-relief representation of a sports ball thereon. Multiple laminations may be constructed as desired, to form any practicable configuration or representation.

Two-dimensional representations may be applied to the various accessories, as in the exemplary accessories 12*c* and 12*d* of FIG. 1. Each of these accessories includes a front face, respectively 60*c* and 60*d*, comprising a two-dimensional representation that has been coated with a transparent protective coating (e.g., epoxy, plastic, etc.). The two-dimensional representations may comprise different monograms as shown, photographs or caricatures, etc., as desired.

FIG. 2 provides a more detailed view of the front face 60*e* of an interchangeable accessory 12*e* attached to the belt or strap 10. The exemplary accessory 12*e* has a front face 60*e* comprising or including a reflective surface or the like. FIG. 2 also illustrates further accessory embodiments 12*f* and 12*g*. The interchangeable accessory 12*f* includes a back portion 28*f* with a front face 60*f* hingedly attached thereto. The back portion 28*f* and front face 60*f* define a storage compartment when they are closed. The storage compartment may include a mirror or mirrors, make-up, and/or other articles as desired. The interchangeable accessory 12*g* may have a front face 60*g* comprising an electrically illuminated display of some sort. Examples include smart phones, miniaturized computer games, GPS receivers and displays, etc. The interchangeable accessories may comprise or include myriad variations and embodiments as desired, with limitation imposed only by practicable size and weight limits.

It is to be understood that the present invention is not limited to the embodiments described above, but encompasses any and all embodiments within the scope of the following claims.

I claim:

1. A belt with interchangeable accessories, comprising:

a flexible, elongate strap having mutually opposed upper and lower edges and mutually opposed outer and inner surfaces, each of the edges having a plurality of spaced apart notches formed therein, the inner surface having a plurality of laterally disposed channels disposed therein, each of the channels extending between corresponding notches;

at least one accessory adapted for removable installation upon the strap, the accessory having an exposed decorative face when installed upon the strap and an attachment face opposite the decorative face, the attachment face having upper and lower elastic loops extending therefrom, each of the loops being adapted for removable placement within corresponding notches and channels of the strap; and a fastening member.

2. The belt with interchangeable accessories according to claim 1, further comprising:

the outer surface of the strap having at least one accessory attachment receptacle disposed therein; and the attachment face of the accessory having a protruding button disposed generally centrally thereon, the elastic loops extending from the button, the protruding button of the accessory seating within the accessory attachment receptacle of the strap when the accessory is installed upon the strap.

3. The belt with interchangeable accessories according to claim 1, further comprising:

the fastening member having a rear portion with a first strap passage disposed laterally therethrough, the rear portion of the fastening member having a rear wall with a selectively closed clasp hingedly disposed therein, the clasp defining a portion of the rear wall and first strap passage of the fastening member when closed, the clasp further having a plurality of belt gripping teeth extending therefrom, the fastening member further having a front portion overlying the rear portion, the front portion of the fastening member having a channel disposed laterally therethrough and a selectively closed cover hingedly disposed therealong, the cover defining a second strap passage when closed, the cover further having at least one inwardly disposed pin adapted to engage a corresponding one of the notches of the strap when the cover is closed with the strap disposed within the second strap passage, the second strap passage overlying the first strap passage.

4. The belt with interchangeable accessories according to claim 1, wherein the strap is formed of silicone plastic material.

5. The belt with interchangeable accessories according to claim 1, wherein the decorative face of the accessory is selected from the group consisting of two-dimensional representations having a transparent protective coating disposed thereover, a plurality of laminated plastic sheets forming a three-dimensional representation, and a reflective surface.

6. The belt with interchangeable accessories according to claim 1, wherein the accessory includes a storage compartment therein.

7. The belt with interchangeable accessories according to claim 1, wherein the accessory includes an electrically illuminated display disposed therewith.

8. The belt with interchangeable accessories according to claim 1, wherein the fastening member is a buckle removably disposed with the strap.

9. A belt with interchangeable accessories, comprising:

a flexible, elongate strap having an outer surface with at least one accessory attachment receptacle disposed therein, the strap being formed of silicone plastic material;

at least one accessory adapted for removable installation upon the strap, the accessory having an exposed decorative face when installed upon the strap and an attachment face opposite the decorative face, the attachment face having a protruding button disposed generally centrally thereon, the button having upper and lower elastic loops extending therefrom, each of the loops being adapted for securing the accessory to the strap, the protruding button of the accessory seating within the accessory attachment receptacle of the strap when the accessory is installed upon the strap; and a buckle removably disposed with the strap.

10. The belt with interchangeable accessories according to claim 9, further comprising:

the strap further having mutually opposed upper and lower edges and an inner surface opposite the outer surface, each of the edges having a plurality of spaced apart notches formed therein, the inner surface having a plurality of laterally disposed channels disposed therein, each of the channels extending between corresponding notches; and each of the loops of the accessory being adapted for removable placement within corresponding notches and channels of the strap.

11. The belt with interchangeable accessories according to claim 9, wherein/further comprising;

the buckle having a rear portion with a first strap passage disposed laterally therethrough, the rear portion of the buckle having a rear wall with a selectively closed clasp hingedly disposed therein, the clasp defining a portion of the rear wall and first strap passage of the buckle when closed, the clasp further having a plurality of belt gripping teeth extending therefrom, the buckle further having a front portion overlying the rear portion, the front portion of the buckle having a channel disposed laterally therethrough and a selectively closed cover hingedly disposed therealong, the cover defining a second strap passage when closed, the cover further having at least one inwardly disposed pin adapted to engage a corresponding one of the notches of the strap when the cover is closed with the strap disposed within the second strap passage, the second strap passage overlying the first strap passage.

12. The belt with interchangeable accessories according to claim 9, wherein the strap is formed of silicone plastic material.

13. The belt with interchangeable accessories according to claim 9, wherein the decorative face of the accessory is selected from the group consisting of two-dimensional representations having a transparent protective coating disposed thereover, a plurality of laminated plastic sheets forming a three-dimensional representation, and a reflective surface.

14. The belt with interchangeable accessories according to claim 9, wherein the accessory includes a storage compartment therein.

15. The belt with interchangeable accessories according to claim 9, wherein the accessory includes an electrically illuminated display disposed therewith.

16. A belt with interchangeable accessories, comprising:

a flexible, elongate strap having mutually opposed upper and lower edges and mutually opposed outer and inner surfaces, each of the edges having a plurality of spaced apart notches formed therein, the strap being formed of silicone plastic material;

a buckle having a rear portion with a first strap passage disposed laterally therethrough, the rear portion of the buckle having a rear wall with a selectively closed clasp hingedly disposed therein, the clasp defining a portion of the rear wall and first strap passage of the buckle when closed, the clasp further having a plurality of belt gripping teeth extending therefrom, the buckle further having a front portion overlying the rear portion, the front portion of the buckle having a channel disposed laterally therethrough and a selectively closed cover hingedly disposed therealong, the cover defining a second strap passage when closed, the cover further having at least one inwardly disposed pin adapted to engage a corresponding one of the notches of the strap when the cover is closed with the strap disposed within the second strap passage, the second strap passage overlying the first strap passage; and at least one accessory adapted for removable installation upon the strap.

17. The belt with interchangeable accessories according to claim 16, further comprising:

the inner surface of the strap further having a plurality of laterally disposed channels disposed therein, each of the channels extending between corresponding notches; and the accessory having an exposed decorative face when installed upon the strap and an attachment face opposite the decorative face, the attachment face having upper and lower elastic loops extending therefrom, each of the loops being adapted for removable placement within corresponding notches and channels of the strap.

18. The belt with interchangeable accessories according to claim 16, further comprising:

the outer surface of the strap having at least one accessory attachment receptacle disposed therein; and the accessory having an exposed decorative face when installed upon the strap and an attachment face opposite the decorative face, the attachment face having a protruding button disposed generally centrally thereon, the protruding button seating within the accessory attachment receptacle of the strap when the accessory is installed upon the strap, the button further having upper and lower elastic loops extending therefrom, each of the loops being adapted for removable placement within corresponding notches and channels of the strap.

19. The belt with interchangeable accessories according to claim 16, wherein the decorative face of the accessory is selected from the group consisting of two-dimensional representations having a transparent protective coating disposed thereover, a plurality of laminated plastic sheets forming a three-dimensional representation, and a reflective surface.

20. The belt with interchangeable accessories according to claim 16, wherein the accessory includes a storage compartment therein.

* * * * *